US006053349A

United States Patent [19]

Griggs, Jr. et al.

[11] Patent Number: 6,053,349

[45] **Date of Patent: *Apr. 25, 2000**

[54] BEVERAGE CAN IDENTIFICATION APPARATUS AND METHOD FOR REDUCING THE SPREAD OF DISEASE BY LIMITING THE CHANCE OF INADVERTENT DRINKING FROM AN OPEN CAN OF ANOTHER

[76] Inventors: Eugene S. Griggs, Jr., 3729 SW. Fifth St., Cape Coral, Fla. 33991; Joanne Hayes, 1139 Kachina Dr., Colorado Springs, Colo. 80915

[ * ] Notice: Under 35 U.S.C. 154(b), the term of this patent shall be extended for 615 days.

[21] Appl. No.: 08/585,485

[22] Filed: Jan. 16, 1996

[51] Int. Cl.[7] ..... G09F 9/40

[52] U.S. Cl. ..... 220/269; 220/906; 215/230; 116/307; 116/201; 116/320; 40/307

[58] Field of Search ..... 220/269, 212, 220/906; 215/228, 230; 116/307, 308, 309, 311, 312, 315, 318; 206/217, 315.9; 283/70; 40/307

[56] References Cited

U.S. PATENT DOCUMENTS

| | | | |
|---|---|---|---|
| 4,729,472 | 3/1988 | Lubin et al. | 116/308 |
| 5,358,117 | 10/1994 | Adams | 116/308 X |
| 5,386,795 | 2/1995 | Bartholomew | 116/315 X |
| 5,492,077 | 2/1996 | Rose | 116/307 |

FOREIGN PATENT DOCUMENTS

| | | | |
|---|---|---|---|
| 65302 | 11/1982 | European Pat. Off. | 116/307 |
| 345726 | 5/1960 | Switzerland | 116/318 |

*Primary Examiner*—Nathan J. Newhouse
*Attorney, Agent, or Firm*—Rines and Rines

[57] ABSTRACT

A technique for avoiding the risk of spreading communicable diseases in drinking inadvertently from another's open beverage can by applying distinctive user identification markers on the can top cover, positioned arcuately about the cover and identified by using the lever-opener also as an identification indicator through rotational alignment with and locking at a desired user's marker.

29 Claims, 1 Drawing Sheet

BEVERAGE CAN IDENTIFICATION APPARATUS AND METHOD FOR REDUCING THE SPREAD OF DISEASE BY LIMITING THE CHANCE OF INADVERTENT DRINKING FROM AN OPEN CAN OF ANOTHER

The present invention relates to beverage cans as of the blown aluminum cylindrical types and the like, widely use for beer, juices, water, soft drinks and other beverages; being more particularly directed to cans carrying pivoted frame-lever tab openers that, when elevated by the fingers, downwardly depress a tongue segment scored in the can top cover surface to provide a drinking access opening.

BACKGROUND

Beverage cans of the above type are described, for example, in U.S. Pat. Nos. 4,372,462; 5,011,037; 5,065,882; 5,131,555; 5,129,541; 5,224,618; 5,307,947; 5,375,729; and 5,411,159. Such have been and continue to be widely used in many different settings to consume the beverages by drinking from the cans, often in social gatherings and public places, where the opened can is from time to time rested on a table or bar or the like by the user before being picked up for resuming further drinking from the can.

Beverages served in translucent or transparent glasses can be readily kept track of by indentificable colors or designs, or by colored or marked coasters or tags, or by visual content inspection. While for beverage cans it has been proposed to supply external spring clip identifying tags (U.S. Pat. Nos. 2,976,629 and 5,358,770), coasters (U.S. Pat. No. 2,814,267), cover lids or plates (U.S. Pat. Nos. 3,392,468 and 3,822,496), lid markings for punching as to indicate a date (U.S. Pat. No. 3,201,524), cans as of beer, soda, water, iced tea, juices and other beverages are not easily or inherently identified or distinguished; and, in this present age of very serious and often fatal disease communication through saliva exchange, a user inadvertently picking up and drinking from another's opened can have disastrous consequences.

It is to the provision of a universal, practical, simple, inherent and inexpensive solution of such and related identification problems that the present invention is primarily directed.

OBJECTS OF INVENTION

A primary objective of the invention, accordingly, is to provide an improved beverage can top of the above-described or similar types in which the lever tab opener can also be used as a user-identification indicator in consort with novel identifying markers arcuately provided on the can cover surface, such that rotation of the lever opener into alignment with a desired marker to be used to identify a specific user and restraining the lever in that identifying position, can materially assist in avoiding inadvertent or mistaken drinking from the can by another.

A further object is to provide thereby a novel method or technique for minimizing the spread of saliva-communicated or other mouth-spreading diseases, by providing such user-distinguishing markers, and, upon the vertical pivotable lever opening of the can, then bending the lever horizontally and rotating it to align with different desired markings at successive angular positions to distinguish different respective users and thereby minimize accidental drinking from the opened can of another.

Other and further objects will be explained hereinafter and are more fully delineated in the appended claims.

SUMMARY

In summary, from one of its aspects, the invention provides for use with a cylindrical beverage can having a top cover surface provided with a substantially centrally pivoted lever upwardly hingedly pivotable to open a substantially radially extending opening in the cover surface to enable drinking of the beverage, and horizontally rotatable about the pivot over the cover surface, a method of reducing the potential for spreading germs and diseases through a user inadvertently drinking from the opened can of another, that comprises, providing distinctive markings on the cover surface at successive angular positions around the pivot for identifying the different users; rotating the lever in a substantially horizontal plane about the pivot radially to align the lever with a selected positional marker representing a particular user; and restraining the lever once rotated to the selected marker position against inadvertent rotation to a different marker.

From an apparatus viewpoint, the invention provides in a cylindrical beverage can top cover surface, a radially extending separable depressable tongue segment on the cover surface, a lever tab substantially centrally pivoted to the cover surface and extending on one side of the pivot over an adjacent portion of the tongue segment and provided with a fingergrip on the other side; the upward elevating of the grip by fingers causing said one side of the lever hingedly to pivot downwardly against the separable tongue segment, breaking the tongue segment away from and depressing it below the cover surface and into the can, defining a beverage drinking opening in the cover surface; the lever being bendable back to a substantially horizontal position parallel to the cover surface and being rotatable about the pivot to successive angular orientations thereabout; a plurality of position markers provided upon the cover surface arcuately about the opening and with which the lever may be rotatably aligned to associate a particular marker position with a particular can user, thereby to avoid inadvertent drinking from a user's can by another user with risk of communicable disease spreading; and means being provided once the lever has been aligned with a selected marker for locking or restraining the lever in the selected position.

Preferred and best mode designs and techniques are more fully hereinafter presented.

DRAWINGS

The invention will now be described with reference to the accompanying drawings, FIG. 1 of which is a top elevation of a prior art unopened beverage can cover surface with its frame-type lever tab opener;

DESCRIPTION OF PREFERRED EMBODIMENT(S)

Figure 1:
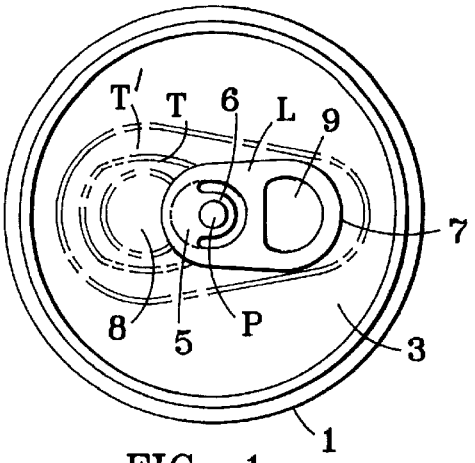
FIG. 1 PRIOR ART

Referring to FIG. 1, the conventional beverage aluminum can before discussed is shown at 1, carrying on its top cover surface 3, a lever opener L generally in the form of a resilient sheet metal elongated frame tab pivoted to substantially the center of the cover at P, and having a rounded finger grip end 7, apertured at 9 to aid in grasping to elevate the opener; and, at the other rounded end, the attachment lug 5 to the pivot P and a crescent opening 6 there-beyond.

A radially extending tongue segment T, peripherally scored at $T^1$, is rearwardly overlayed by the lever end 5, usually over a raised intermediate land portion 8.

Figure 2:
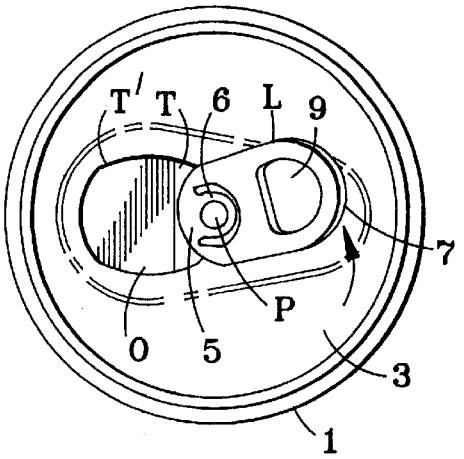
FIG. 2 is a similar view after the lever has been elevated to open a drinking aperture or opening in the can cover.

To open the can cover at the tongue region, the finger grip end 7–9 of the lever opener L is vertically bent upwardly, FIG. 2, hingedly elevating the lever vertically about the fixed pivot point P, with the lever end 5 partially bending downwardly against the tongue T-8, breaking or tearing the tongue away from the cover along the scoring $T^1$ and depressing the tongue downwardly into the can and beverage and to a rearward side, forming the drinking opening O, much in the manner described in the previously mentioned Patents.

Figure 3:
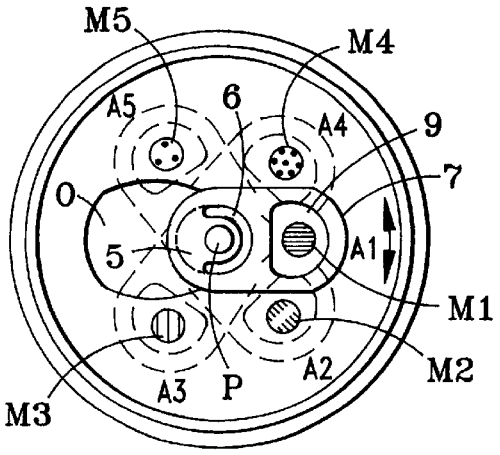
FIG. 3 is a similar elevation of the opened can provided with arcuately disposed user-identifying markers, exposable through the horizontally bent and rotatable finger grip frame aperture or opening.

In accordance with the present invention, the frame lever tab opener L is then bent horizontally flat again, FIG. 3, now to serve a new function as a horizontal-plane rotatable indicator of successive angular positions about the pivot P, as at $A_1$, $A_2$, $A_3$, $A_4$, $A_5$ etc. At such angular positions, and preferably along the circular arcuate path formed by horizontally rotating the finger grip opening 9 about the pivot P, and at substantially the same radius as the center or interior of the opening 9 from the pivot P, corresponding user identification markers are provided arcuately on the cover, as at $M_1$, $M_2$, $M_3$, $M_4$, $M_5$ etc.—such as different colored dots or circles or other markings, respectively exposed by the lever tab frame aperture or opening 9 when aligned at the corresponding selected marker angular positions. By providing sufficient rotational friction at the pivot point P, as by the initial force of swedging it in place, and through spring resilience of the sheet metal frame lever tab L, once the lever is set at the desired angular position, say at $A_1$, it is thus restrained or locked from changing position except by deliberate further rotational force. This insures that once a desired or selected user color is established, it is fixed and can be relied upon to identify that user's can.

Figure 4:
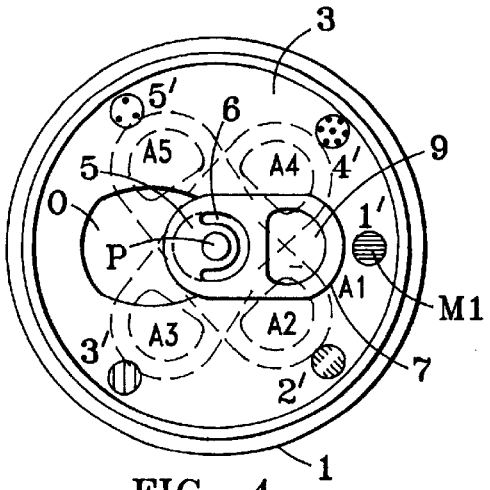
FIG. 4 is a modification with the markers circumferentially provided beyond the finger grip portion of the lever opener.
Figure 5:
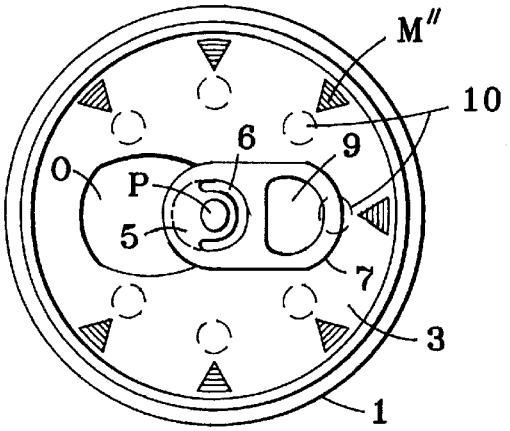
FIG. 5 is a similar view of still a further modification using angular position lever restraining projections or detents and also showing distinguishing color circumferential user-identifying markers.

Alternatively, as in the embodiment of FIG. 5, projections or detents may be provided in the can cover corresponding to the selected angular marker positions, to provide such restraint against lever movement once locked at the desired marker. The detent may, if desired, also be on the end 7 of the lever L, with its natural spring pressure providing rotation restraint once the lever has been rotated to align with the desired distinctive user marker, such as the circumferentially printed or overlaid marker triangles M" of FIG. 5. The markers $M_1$, etc. may also be disposed on the can cover circumferentially outside the finger grip end 7 of the lever as in FIG. 4. They may take the form of printed numbers (1'–5', etc.), letters, patterns, images, shades or colors and any other desired distinguishable marks or indicia for different users, including, also, cover-attached or overlaying markers at M' or M", and/or projections or detents 10, as before described, and the like.

Further modifications will also occur to those skilled in this art, and such are considered to fall within the spirit and scope of this invention as defined in the appended claims.

What is claimed is:

1. In a cylindrical beverage can top cover surface, a radially extending separable depressable tongue segment on the cover surface, a lever tab substantially centrally pivoted to the cover surface and extending on one side of the pivot over an adjacent portion of the tongue segment and provided with a fingergrip on the other side; the upward elevating of the grip by fingers causing said one side of the lever hingedly to pivot downwardly against the separable tongue segment, breaking the tongue segment away from and depressing it below the cover surface and into the can, defining a beverage drinking opening in the cover surface; the lever tab being bendable back to a substantially horizontal position parallel to the cover surface and being rotatable about the pivot to successive angular orientations thereabout; a plurality of cover surface position markers provided arcuately about the opening and with which the lever may be rotatably aligned to associate a particular marker position with a particular can user, thereby to avoid inadvertent drinking from a user's can by another user with risk of communicable disease-spreading; and means being provided once the lever has been aligned with a selected marker for locking or restraining the lever in the selected position.

2. Apparatus as claimed in claim 1 and in which said locking or restraining means comprises the provision of sufficient friction at the pivot against inadvertent horizontal plane rotation of the lever once angularly oriented.

3. Apparatus as claimed in claim 1 and in which said locking or restraining means is a detentor projection.

4. Apparatus as claimed in claim 1 and in which said locking or restraining means is provided by the spring resiliency of the lever.

5. Apparatus as claimed in claim 1 and in which said position markers are selected from the group consisting of different color markers, numerals, letters, images, projections, depressions, printed markings, and cover-attached or overlaying markers.

6. Apparatus as claimed in claim 5 and in which the markers are disposed circumferentially about the cover near or external to the finger grip of the lever.

7. Apparatus as claimed in claim 5 and in which the finger grip portion of the lever is apertured and the markers are disposed arcuately about the pivot in a circle of substantially the same radius as the lever aperture in order to expose the markers through such aperture and to display the selected marker through such aperture when the lever is rotated to the corresponding angular position.

8. Apparatus as claimed in claim 1 and in which the lever is a resilient frame tab having an aperture at the finger grip to facilitate the upward elevating thereof.

9. Apparatus as claimed in claim 8 and in which the lever is further apertured near the pivot to facilitate applying pressure to break the tongue segment upon the elevating of the finger grip.

10. Apparatus as claimed in claim 8 and in which the markers are arcuately provided about the pivot in a circle of substantially the same radius as said aperture.

11. For use with a cylindrical beverage can having a top cover surface provided with a substantially centrally pivoted lever upwardly hingedly pivotable to open a substantially radially extending opening in the cover surface to enable drinking of the beverage, and horizontally rotatable about the pivot over the cover surface, a method of reducing the potential for spreading germs and diseases through a user inadvertently drinking from the opened can of another, that comprises, providing distinctive cover surface markings at successive angular positions around the pivot for identifying the different users; rotating the lever in a substantially horizontal plane about the pivot angularly to align the lever with a selected positional marker representing a particular user; and restraining the lever once rotated to the selected marker position against inadvertent rotation to a different marker.

12. A method as claimed in claim 11 and in which the lever is provided with an aperture, the markings are provided along a circle corresponding to the circular path defined by the aperture as the lever is horizontally rotated about the pivot, and the selected positional marker representing a particular user becomes framed within and exposed through the aperture when the lever is rotated to and restrained at that position.

13. In an easy open closure for a container, the closure of the type having a central panel with an integral rivet element, a displaceable panel portion in said central panel disposed outwardly of said rivet element, said panel portion defined by scoring, a captive lever tab with a distal lift end and a proximal end, said lever tab attached to said central panel by said rivet element between said ends, said lever tab being rotatable about said rivet element, whereby said proximal end breaks away said panel portion at said scoring and bends the panel portion inwardly along an unscored portion to provide an unobstructed opening and top when said distal lift end is lifted and then lowered to be adjacent said central panel, the improvement comprising:

a plurality of indicia, each one different from the others, disposed in an arc on said central panel, said arc substantially centered on said rivet element, said indicia being spaced apart from one another sufficiently so that said distal lift end of said lever tab may be rotated to point to a selected one of said indicia to thereby identify said container after said closure has been opened.

14. The closure according to claim 13, and in which said indicia are alphanumeric.

15. The closure according to claim 13, in which said indicia are graphics.

16. The closure according to claim 13, in which said indicia are imprinted on said central panel.

17. The closure according to claim 13, in which said indicia are embossed on said central panel.

18. The closure according to claim 13, in which said indicia are engraved on said central panel.

19. An easy open closure for a container that has a captive lever tab rotatably held on a central panel, wall by a rivet element, the lever tab having a proximal end for breaking open a scored panel portion to provide an opening and a distal lift end for lifting up to force the proximal end down for said breaking, the improvement comprising:

a plurality of spaced apart unique indicia disposed on said central panel wall in an arc, the arc substantially centered on said rivet element and extending through an angle of less than two hundred degrees so that after said closure has been opened, said distal lift end may be lowered and rotated to point to a selected one of said indicia to thereby uniquely identify said container without obstructing said opening.

20. The closure according to claim 19, in which said indicia are alphanumeric.

21. The closure according to claim 19, in which said indicia are graphics.

22. The closure according to claim 19, in which said indicia are imprinted on said central panel wall.

23. The closure according to claim 19, in which said indicia are embossed on said central panel wall.

24. The closure according to claim 19, in which said indicia are engraved on said central panel wall.

25. In an easy open beverage container having a captive lever tab with a lifting end rotatably attached to an end wall by a rivet element for breaking open a scored panel portion to provide an opening, a method for identifying an opened container comprising the steps of:

(A) applying a plurality of unique spaced-apart indicia on said end wall in an arc of about two hundred degrees away from said opening, said arc substantially centered on said rivet element;

(B) lowering said tab substantially against said end wall after opening said container; and (C) rotating said tab about said rivet element so that said lifting end points at a unique one of said indicia to thereby uniquely identify said opened container.

26. In a cylindrical beverage can top resilient cover surface, a radially extending separable depressable tongue segment on the cover surface, a resilient metal frame lever tab substantially centrally pivoted to the cover surface and extending on one side of pivot over an adjacent portion of the tongue segment and provided with a fingergrip on the other side; the upward elevating of the grip by fingers causing one side of the lever hingedly and resiliently to pivot downwardly against the separable tongue segment, breaking the tongue segment away from and depressing it below the cover surface and into the can, defining a beverage drinking opening in the cover surface; the lever tab being resiliently bendable back to a nearly horizontal position over the cover surface, but with the finger grip end of the bent-back tab slightly resiliently raised above the surface and being rotatable about the pivot to successive angular orientations thereabout; a plurality of position markers provided upon the cover surface arcuately about the opening and with which the lever may be rotatably aligned to associate a particular marker position with a particular can user, thereby to avoid inadvertent drinking from a user's can by another user with risk of communicable disease-spreading; and downward projection means being provided at the fingergrip end of the lever for providing resilient locking or restraining of the lever in the position of alignment with a selected marker that supplements pivot-provided friction locking the center of the lever against inadvertent horizontal plane rotation of the lever once angularly oriented.

27. In a cylindrical beverage can top resilient cover surface, a radially extending separable depressable tongue segment on the cover surface, a resilient metal frame lever tab substantially centrally pivoted to the cover surface and extending on one side of the pivot over an adjacent portion of the tongue segment and provided with a fingergrip on the other side; the upward elevating of the grip by fingers causing said one side of the lever hingedly and resiliently to pivot downwardly against the separable tongue segment, breaking the tongue segment away from and depressing it below the cover surface and into the can, defining a beverage drinking opening in the cover surface; the lever tab being resiliently bendable back to a nearly horizontal position over the cover surface, but with the fingergrip end of the bent back tab slightly resiliently raised above the surface and being rotatable about the pivot to successive angular orientations thereabout; a plurality of position markers provided upon the cover surface arcuately about the opening and with which the lever may be rotatably aligned to associate a particular marker position with a particular can user, thereby to avoid inadvertent drinking from a user's can by another user with risk of communicable disease-spreading; and projection means being provided in the cover along said successive angular orientations about the cover but excluding the region of the tongue segment for providing resilient end-locking or restraining of the lever in the position of alignment with a selected marker that supplements center pivot-provided friction locking against inadvertent horizontal plane rotation of the lever once angularly oriented.

28. In a cylindrical beverage can top resilient cover surface, a radially extending separable depressable tongue segment on the cover surface, a resilient metal frame lever tab substantially centrally pivoted to the cover surface and extending radially on one side of the pivot over an adjacent portion of the tongue segment and provided with a radially extending apertured fingergrip on the other side; the upward elevating of the grip by fingers within the aperture causing said one side of the lever hingedly and resiliently to pivot downwardly against the separable tongue segment, breaking the tongue segment away from and depressing it below the cover surface and into the can, defining a beverage drinking opening in the cover surface; the lever tab being resiliently bendable back to a nearly horizontal position over the cover surface and being rotatable about the pivot to successive angular orientations thereabout; a plurality of position markers provided upon the cover surface arcuately about the pivot and in a circle of substantially the same radius as the lever aperture, with which the lever aperture may be rotatably aligned to associate a particular marker position with a particular can user with the aperture displaying the selected marker framed within the aperture, thereby to avoid inadvertent drinking from a user's can by another user with risk of communicable disease-spreading.

29. Apparatus as claimed in claim 28 and in which means is provided for locking or restraining the lever in its position of alignment with a selected marker supplementing the locking action achieved centrally of the lever by pivot function, comprising projection means operative at the finger grip end of the lever for providing resilient locking or restraining at the fingergrip end of the lever against the cover surface thereat.

* * * * *